US007629526B1

(12) United States Patent
Miyajima

(10) Patent No.: US 7,629,526 B1
(45) Date of Patent: Dec. 8, 2009

(54) CYMBAL HOLDER AND CYMBAL STAND

(75) Inventor: Hideyuki Miyajima, Nagoya (JP)

(73) Assignee: Hoshino Gakki Co., Ltd., Nagoya (JP)

( * ) Notice: Subject to any disclaimer, the term of this patent is extended or adjusted under 35 U.S.C. 154(b) by 0 days.

(21) Appl. No.: 12/511,068

(22) Filed: Jul. 29, 2009

(30) Foreign Application Priority Data

May 27, 2009 (JP) ..... 2009-127937

(51) Int. Cl.
*G10D 13/02* (2006.01)

(52) U.S. Cl. ..... 84/422.1

(58) Field of Classification Search ..... 84/422.1, 84/422.3, 421
See application file for complete search history.

(56) References Cited

U.S. PATENT DOCUMENTS 4,960,028 A 10/1990 Ramirez
5,785,480 A 7/1998 Difeo
6,884,015 B1 4/2005 Takegawa
2006/0096444 A1* 5/2006 Sato et al. ..... 84/422.3

FOREIGN PATENT DOCUMENTS

JP 3069348 U 3/2000

* cited by examiner

*Primary Examiner*—Kimberly R Lockett

(57) ABSTRACT

A cymbal holder includes a holder body having an insertion hole, first and second engagement members, and first and second compression coil springs. The first and second engagement members are urged by the first and second compression coil springs such that first and second nut portions approach each other to be engaged with a bolt. When first and second button portions are pressed against the urging force of the first and second compression coil springs, the first and second nut portions are disengaged from the bolt.

12 Claims, 7 Drawing Sheets

CYMBAL HOLDER AND CYMBAL STAND

BACKGROUND OF THE INVENTION

The present invention relates to a cymbal holder that holds a cymbal to a cymbal stand and a cymbal stand having a cymbal holder.

A cymbal stand has a stand body and a cymbal holder that holds cymbal at an upper end of the stand body. Japanese Utility Model No. 3069348 discloses a cymbal holder. The cymbal holder disclosed in the publication has a support member, a retainer and a nut. The support member is attached to an upper end of the stand body. The retainer is attached to a bolt of the support member. The nut is screwed to the bolt. In this cymbal holder, when the cymbal is attached to and detached from the stand body, it is necessary that the nut that is screwed to the bolt be tightened and loosened. In order to facilitate the attachment and detachment of the nut, the following configurations have been proposed.

U.S. Pat. No. 4,960,028 discloses a cymbal holder having a pair of sleeve members that are engaged with a bolt and a coil spring that urges the sleeve members. U.S. Pat. No. 5,785,480 discloses a cymbal holder having a holder body, a nut member and a compression coil spring. The nut member has a nut and an operation button that are integrally formed. The compression coil spring urges the nut member. U.S. Pat. No. 6,884,015 discloses a holder for percussive instruments having a holder body and a pair of rotation members. The holder body has a lock opening and the rotation members are attached to the holder body. In the holder for percussive instruments, an inner peripheral surface of the lock opening is deformed by a cam surface of each rotation member so as to approach an axial line of the lock opening. Accordingly, a screw on the inner peripheral surface of the lock opening is engaged with a screw on the outer surface, and the holder for percussive instruments are attached to the bolt.

However, in the cymbal holder disclosed in U.S. Pat. No. 4,960,028, when the cymbal is struck and shaken, the sleeve member is shaken with the cymbal and removed from the bolt. Accordingly, the cymbal holder can no longer hold the cymbal to the cymbal stand. Only one nut member for engaging the cymbal holder to the bolt is provided in the cymbal holder disclosed in U.S. Pat. No. 5,785,480. Therefore, if a stick contacts a button during a musical performance, the nut member is disengaged from the bolt and the cymbal can no longer be held to the cymbal stand. As in the case of U.S. Pat. No. 4,960,028, when the cymbal is struck and shaken, the cymbal holder is shaken with the cymbal and may come off the bolt. Further, the nut member needs to be made of metal to ensure fastening strength with respect to the bolt. This increases the costs for the members, and the cymbal holder cannot be manufactured with low cost. According to the holder for percussive instruments disclosed in U.S. Pat. No. 6,884,015, it is necessary that the rotation member be locked to the holder body. This makes it troublesome to attach and detach the holder to and from the bolt. Even if the bolt is not properly engaged with the screw portion of the lock opening, the rotation member is forcibly rotated to be locked to the holder body. Accordingly, the screw portion of the lock opening may be damaged and the life of product is shortened.

SUMMARY OF THE INVENTION

An objective of the present invention is to provide a cymbal holder that reliably holds a cymbal to a cymbal stand and a cymbal stand having the cymbal holder.

To achieve the foregoing objective and in accordance with a first aspect of the present invention, a cymbal holder for holding a cymbal by tightening up the cymbal between a retainer supporting the cymbal and the cymbal holder is provided. The cymbal holder is screwed to and tightened up to a bolt projected from an upper end of the retainer so as to hold the cymbal. The cymbal holder includes a holder body, a first operation button and a second operation button, a first split nut and a second split nut, and urging means. The holder body has an insertion opening through which the bolt is inserted. The first operation button and the second operation button are provided to the holder body and operated for attachment and detachment of the cymbal. The first split nut and the second split nut are movably supported in the holder body and engaged with the bolt. The urging means urges at least one of the split nuts. The split nuts are caused to approach each other by urging force of the urging means so as to be engaged with the bolt, and the split nuts are separated from each other by operation of the operation buttons so as to be disengaged from the bolt.

In accordance with a second aspect of the present invention, a cymbal stand including a stand body having a bolt at its distal end and a cymbal holder for holding a cymbal at an upper end of the stand body is provided. The cymbal is held at the stand body by tightening up the cymbal holder that is screwed to the bolt. The cymbal holder includes a holder body, a first operation button and a second operation button, a first split nut and a second split nut, and urging means. The holder body has an insertion opening through which the bolt is inserted. The first operation button and the second operation button are provided on the holder body and operated for attachment and detachment of the cymbal. The first split nut and the second split nut are movably supported in the holder body and engaged with the bolt. The urging means urges at least one of the split nuts. The split nuts are caused to approach each other by urging force of the urging means so as to be engaged with the bolt, and the split nuts are separated from each other by operation of the operation buttons so as to be disengaged from the bolt.

DETAILED DESCRIPTION OF THE PREFERRED EMBODIMENTS

One embodiment of a cymbal holder and a cymbal stand according to the present invention will be explained with reference to FIGS. 1 to 7B.

Figure 1:
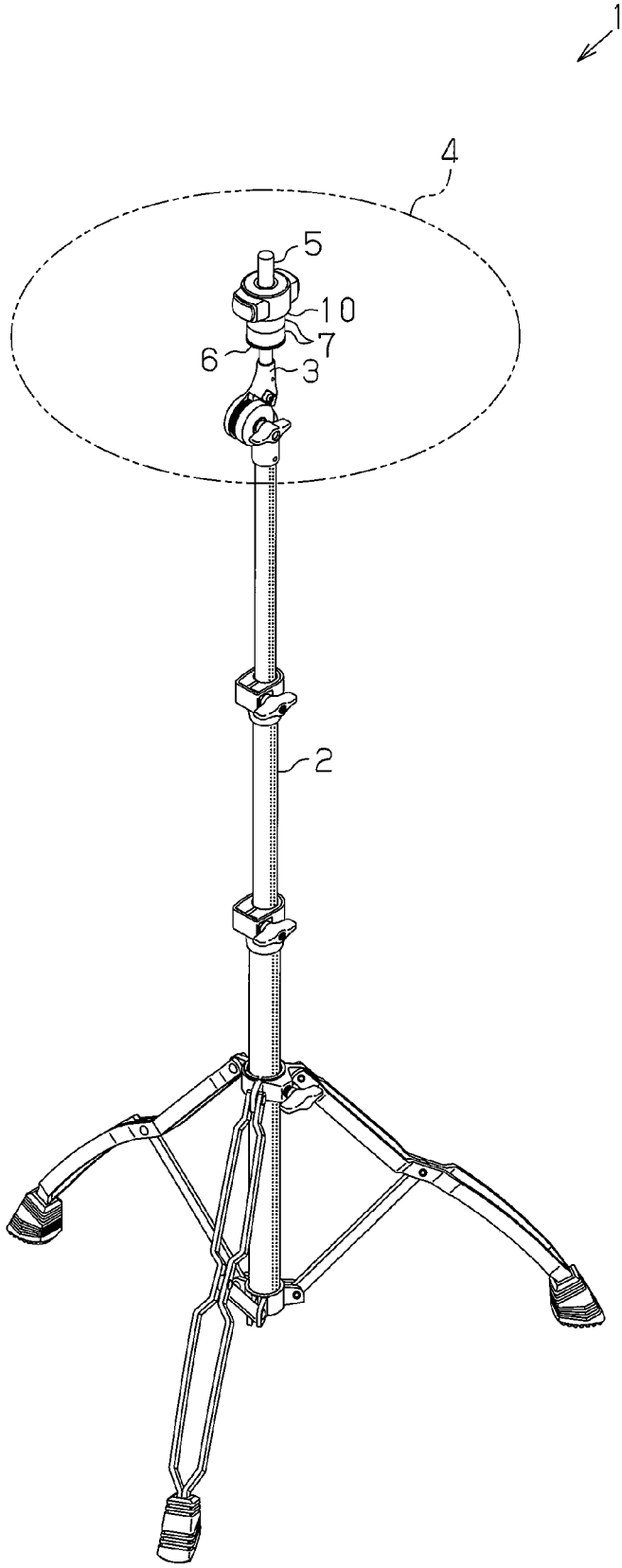
FIG. 1 is a perspective view of a cymbal stand according to one embodiment of the present invention.

As shown in FIG. 1, a cymbal stand 1 has a stand body 2 including a tripod, a tilter 3 and a cymbal holder 10. The tilter 3 is rotatably supported at an upper end of the stand body 2. A bolt 5 to which the cymbal holder 10 is screwed is provided at an upper end of the tilter 3. A retainer 6 for supporting a cymbal 4 from below is provided to the tilter 3. The cymbal 4 is held at an upper end of the stand body 2 by tightening the cymbal holder 10 that is screwed to the bolt 5. A shock absorbing member 7 made of felt is provided between the cymbal 4 and the retainer 6 and between the cymbal 4 and the cymbal holder 10 to absorb vibration of the cymbal 4.

Figure 2:
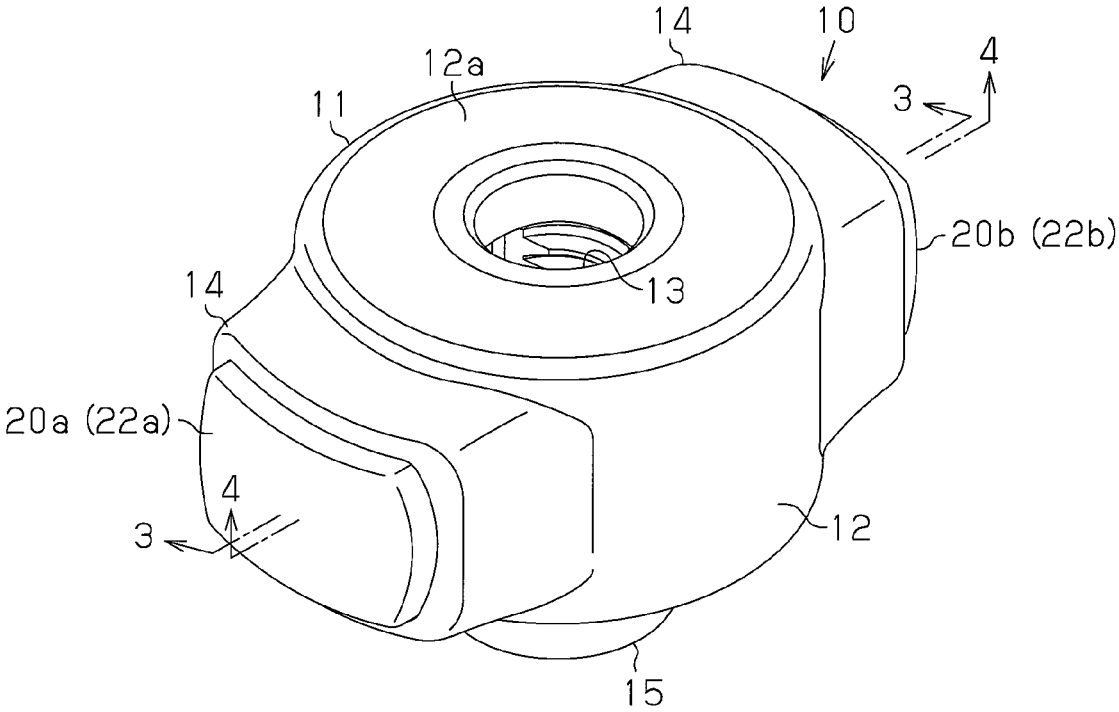
FIG. 2 is a perspective view of a cymbal holder according to one embodiment of the present invention.
Figure 3:
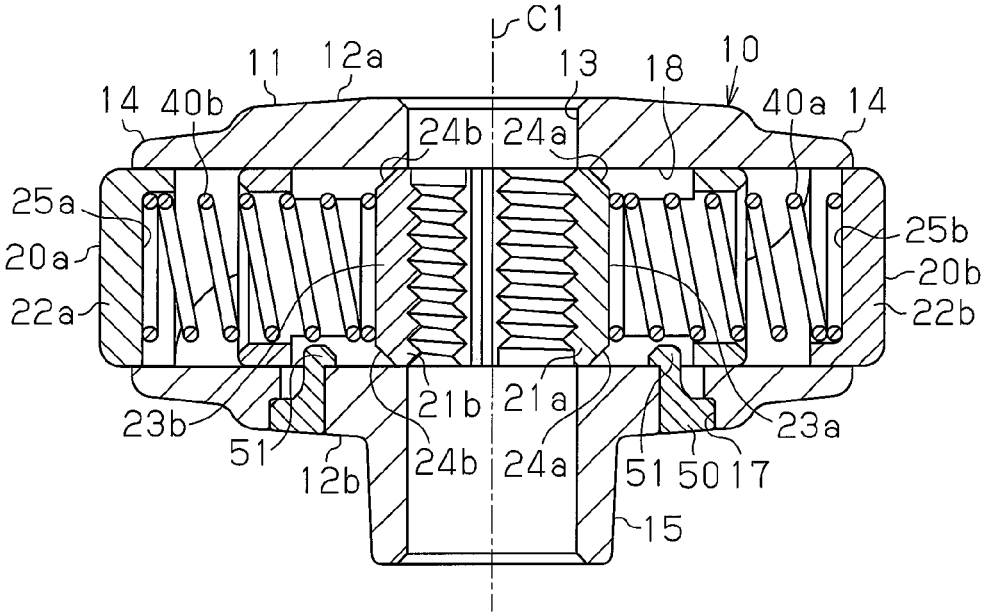
FIG. 3 is a cross-sectional view taken along line 3-3 of FIG. 2.
Figure 5:
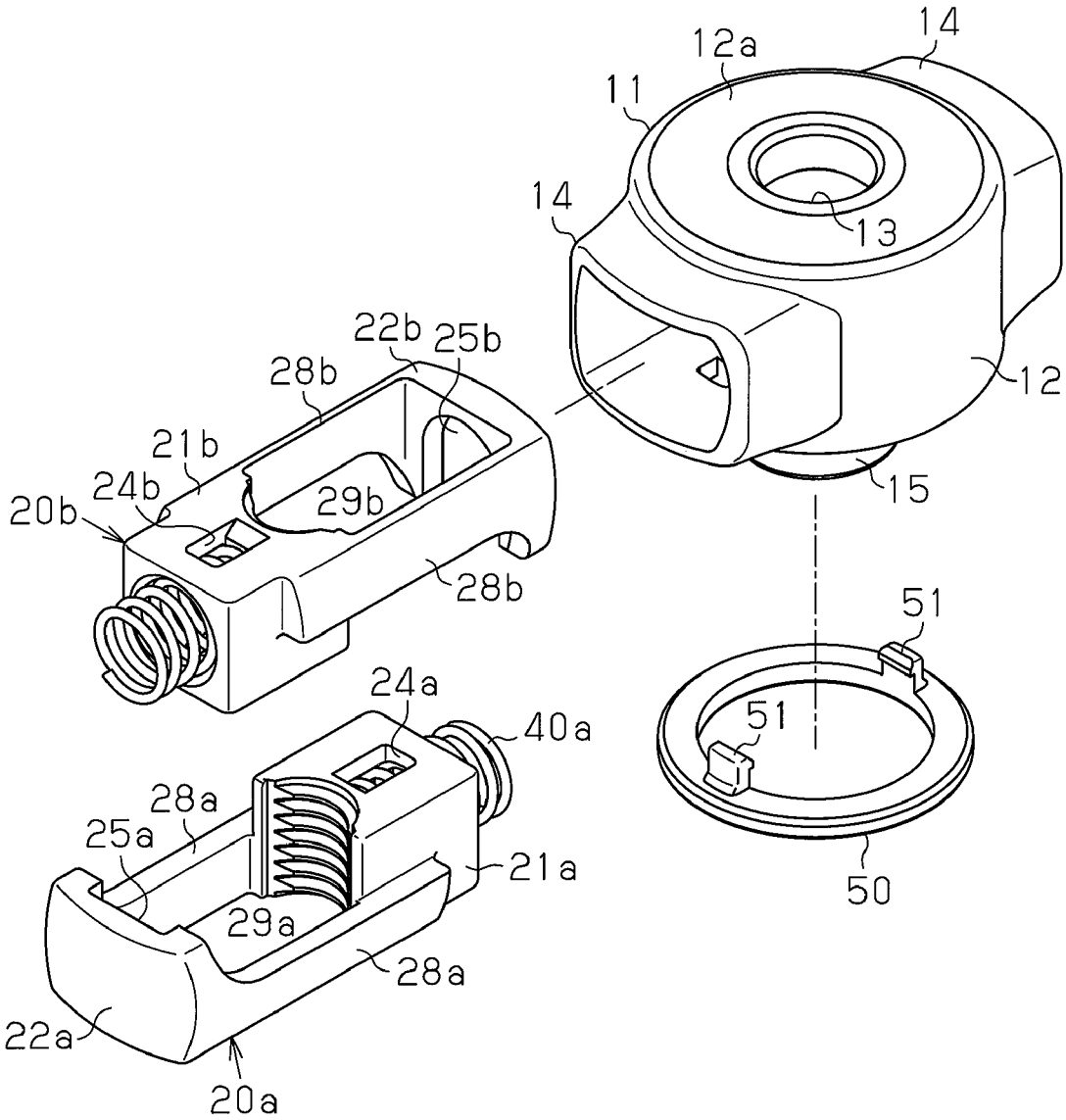
FIG. 5 is an exploded perspective view of the cymbal holder.

As shown in FIGS. 2, 3 and 5, the cymbal holder 10 has a holder body 11, first and second engagement members 20*a*, 20*b*, first and second compression coil springs 40*a*, 40*b*, which are first and second urging means, and a ring 50 that is a retaining member. The holder body 11, the first and second engagement members 20*a*, 20*b* and the ring 50 are made of a resin material. The resin material includes, for example, nylon resin, polyethylene resin, polycarbonate resin, and polyacetal resin.

The holder body 11 has a cylindrical portion 12 including upper and lower surfaces 12*a*, 12*b* and a pair of rectangular tube portions 14 that are laterally protruded from a peripheral surface of the cylindrical portion 12. An insertion hole 13 is formed at a center of the cylindrical portion 12. The bolt 5 is inserted through the insertion hole 13. The inner diameter of the insertion hole 13 is set to be within a range of 1 to 11/10 times the outer diameter of the bolt 5.

A cylindrical projection portion 15 through which the bolt 5 is inserted is provided on the lower surface 12*b* of the cylindrical portion 12. The projection portion 15 is formed in a cylindrical shape having the same axis as the insertion hole 13. The projection portion 15 has a smaller diameter than the cylindrical portion 12. An annular groove 17 is formed on the lower surface 12*b* of the cylindrical portion 12. The groove 17 extends along an outer peripheral edge of the proximal end of the projection portion 15.

An opening having a rectangular cross section is formed in each rectangular tube portion 14. The openings of the rectangular tube portions 14 are arranged symmetric with respect to the axial line C1 of the insertion hole 13. A communication opening 18 is formed in the holder body 11 so as to be perpendicular to the axial line C1 of the insertion hole 13. The communication opening 18 connects the openings of the rectangular tube portions 14 to each other. The communication opening 18 is formed as an elongated opening having a cross section of the same shape as the opening of the rectangular tube portion 14.

According to the present embodiment, the first engagement member 20*a* includes a first split nut and a first operation button that are integrally formed. The first engagement member 20*a* has the first split nut as a first nut portion 21*a*, and the first operation button as a first button portion 22*a*. The second engagement member 20*b* includes a second split nut and a second operation button that are integrally formed. The second engagement member 20*b* has the second split nut as a second nut portion 21*b*, and the second operation button as a second button portion 22*b*. The first and second engagement members 20*a*, 20*b* have the same shape and size.

The first nut portion 21*a* has a screw on a surface facing the first button portion 22*a*. The screw is engaged with the bolt 5. The first nut portion 21*a* has a first accommodation hole 23*a* for accommodating a first compression coil spring 40*a* on a surface opposite to the first button portion 22*a*. A first fitting opening 24*a* for engagement with the ring 50 is provided on an upper surface and a lower surface of the first nut portion 21*a*. The first button portion 22*a* has a first support recess 25*a* on a surface facing the first nut portion 21*a*. The first support recess 25*a* supports an end portion of a second compression coil spring 40*b*.

Similarly, the second nut portion 21*b* has a screw on a surface facing the second button portion 22*b*. The screw is engaged with the bolt 5. The second nut portion 21*b* has a second accommodation opening 23*b* on a surface opposite to the second button portion 22*b*. The second accommodation opening 23*b* accommodates a second compression coil spring 40*b*. A second fitting opening 24*b* for the engagement with the ring 50 is provided on an upper surface and a lower surface of the second nut portion 21*b*. The second button portion 22*b* has a second support recess 25*b* on a surface facing the second nut portion 21*b*. The second support recess 25*b* supports an end portion of the second compression coil spring 40*b*. Each screw of the first and second nut portions 21*a*, 21*b* is a split screw that is formed by separating a female screw along its axial line.

A pair of first frames 28*a* are provided between the first nut portion 21*a* and the first button portion 22*a* so as to connect them to each other. The first engagement member 20*a* has a first accommodation space 29*a* that is surrounded by the first nut portion 21*a*, the first button portion 22*a*, and the pair of first frames 28*a*. Similarly, a pair of second frames 28*b* are provided between the second nut portion 21*b* and the second button portion 22*b* so as to connect them to each other. The second engagement member 20*b* has a second accommodation space 29*b* that is surrounded by the second nut portion 21*b*, the second button portion 22*b*, and the pair of second frames 28*b*. The second nut portion 21*b* and the second compression coil spring 40*b* are accommodated in the first accommodation space 29*a* of the first engagement member 20*a*. The first nut portion 21*a* and the first compression coil spring 40*a* are accommodated in the second accommodation space 29*b* of the second engagement member 20*b*.

As shown in FIGS. 3 to 5, the first and second engagement members 20*a*, 20*b* are integrally assembled to each other so as to face each other. In a state where the engagement members 20*a*, 20*b* are assembled, the first end of the first compression coil spring 40*a* is accommodated in the first accommodation hole 23*a*, and the second end of the first compression coil spring 40*a* is fitted to the second support recess 25*b* of the second button portion 22*b*. The first end of the second compression coil spring 40*b* is accommodated in the second accommodation opening 23*b*, and the second end of the second compression coil spring 40*b* is fitted to the first support recess 25*a* of the first button portion 22*a*. The first compression coil spring 40*a* is compressed and supported between the first nut portion 21*a* and the second button portion 22*b*. The second compression coil spring 40*b* is compressed and supported between the second nut portion 21*b* and the first button portion 22*a*. In other words, the first compression coil spring 40*a* is supported by the first nut portion 21*a* and the second button portion 22*b* while storing urging force, and the second compression coil spring 40*b* is supported by the second nut portion 21*b* and the first button portion 22*a* while storing urging force.

The first and second compression coil springs 40*a*, 40*b* urge the first and second engagement members 20*a*, 20*b* toward each other, that is, in a direction for engaging the nut portions 21*a*, 21*b* with the bolt 5. On the other hand, when the first and second button portions 22*a*, 22*b* are pressed against the urging force of the first and second compression coil springs 40*a*, 40*b*, the first and second engagement members 20*a*, 20*b* slide such that the first and second nut portions 21*a*, 21*b* are separated from each other. Accordingly, the first and second nut portions 21*a*, 21*b* are separated such that the space 26 between the first nut portion 21*a* and the second nut portion 21*b* becomes greater than the diameter of the bolt 5 that is engaged with the nut portions 21*a*, 21*b*.

The first and second engagement members 20*a*, 20*b* are accommodated in the communication opening 18 of the holder body 11 in a state where the first and second engagement members 20*a*, 20*b* are assembled as described above. The first and second engagement members 20*a*, 20*b* are arranged such that the space 26 between the first nut portion 21*a* and the second nut portion 21*b* coincides with the insertion hole 13. The ring 50 is mounted in the groove 17 formed on the holder body 11. A pair of hooks 51 are provided on the inner peripheral surface of the ring 50. The hooks 51 are arranged symmetrically with respect to the axial line of the ring 50. Each of the hooks 51 is engaged with each of the fitting openings 24*a*, 24*b* of the first and second nut portions 21*a*, 21*b*. Accordingly, the first and second engagement members 20*a*, 20*b* are attached to a predetermined position in the holder body 11 and held in the holder body 11 so as not to come off from the holder body 11.

Next, a using method of the cymbal holder 10 will be explained with reference to FIGS. 4A, 4B, 6A to 6C, 7A and 7B.

Figure 4A:
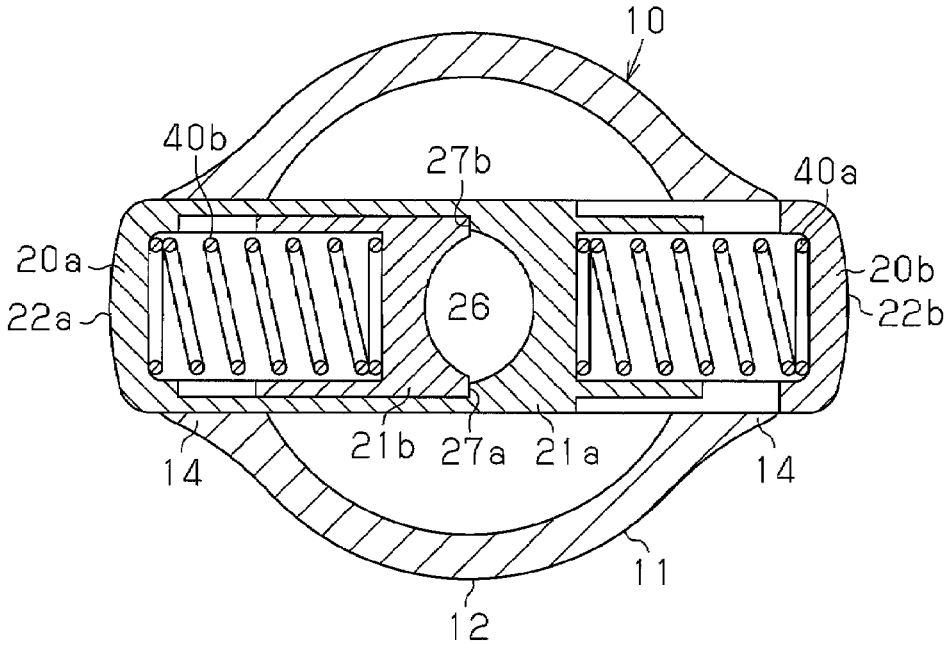
FIG. 4A is a cross-sectional view taken along line 4-4 line of FIG. 2.
Figure 6A:
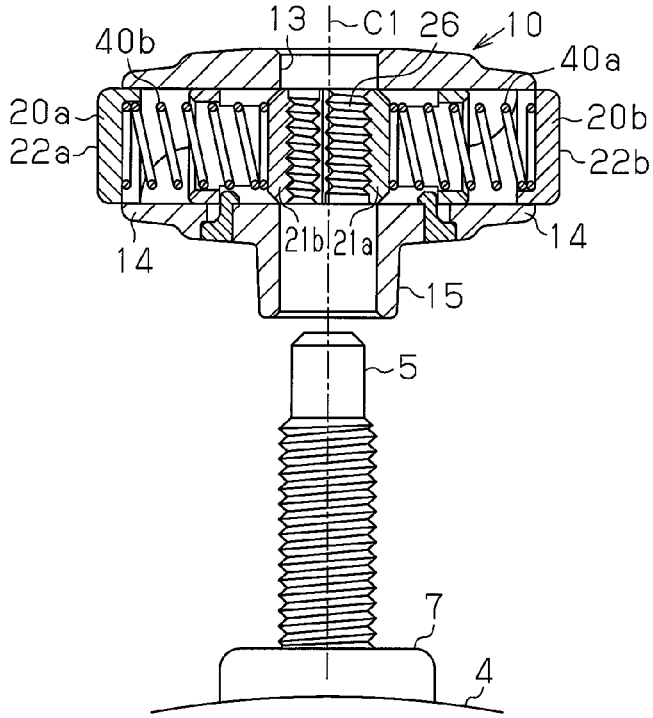
FIG. 6A is a partial cross-sectional view showing a state immediately before the cymbal holder is attached to the bolt.

As shown in FIG. 6A, after the cymbal 4 and the shock absorbing member 7 are mounted to the bolt 5, the cymbal holder 10 is arranged above the bolt 5. In this state, the first and second engagement members 20*a*, 20*b* are urged by the first and second compression coil springs 40*a*, 40*b* such that the first and second nut portions 21*a*, 21*b* approach each other. Therefore, as shown in FIG. 4A, the first and second engagement members 20*a*, 20*b* are supported in the holder body 11 in a state where the split surfaces 27*a*, 27*b* of the first and second nut portions 21*a*, 21*b* are caused to contact each other.

Figure 4B:
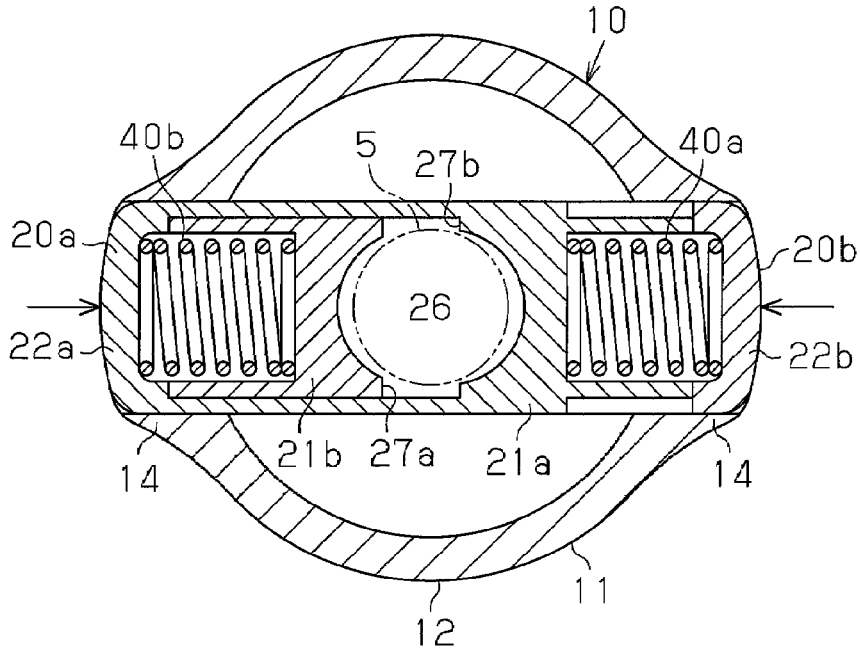
FIG. 4B is a cross-sectional view showing a state where a first button portion and a second button portion are pressed from the state shown in FIG. 4A.
Figure 6B:
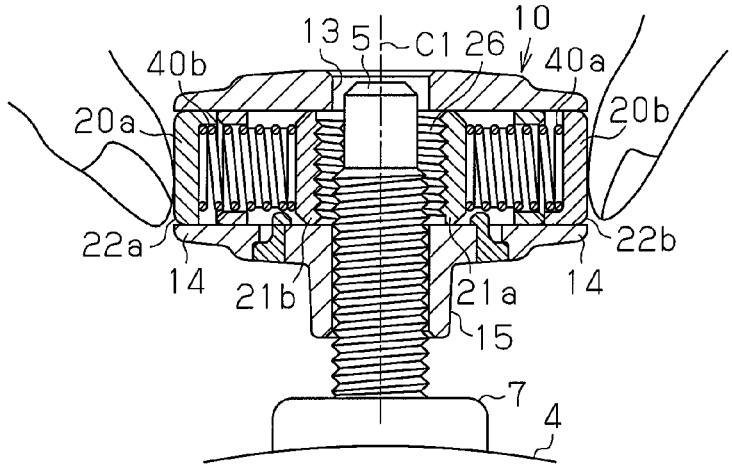
FIG. 6B is a partial cross-sectional view showing a state where the cymbal holder is screwed into the bolt.

Next, as shown in FIG. 6B, the first and second button portions 22*a*, 22*b* are pinched and pressed by fingers. Accordingly, the first and second engagement members 20*a*, 20*b* slide in the holder body 11 such that the first and second nut portions 21*a*, 21*b* are separated from each other. As shown in FIG. 4B, the first and second nut portions 21*a*, 21*b* are separated until the space 26 between the first and second nut portions 21*a*, 21*b* becomes greater than the diameter of the bolt 5. The size of the first and second fitting openings 24*a*, 24*b* is set such that the sliding of the first and second engagement members 20*a*, 20*b* is not restricted by the hooks 51 of the ring 50.

The bolt 5 is inserted through the insertion hole 13 of the holder body 11 while the first and second button portions 22*a*, 22*b* are pressed, and the first and second button portions 22*a*, 22*b* are released from the pressed state when the bolt 5 is in a proper position. This engages the first and second nut portions 21*a*, 21*b* with the bolt 5, and the cymbal holder 10 is screwed to the bolt 5. At this time, as shown in FIG. 4B, the first and second nut portions 21*a*, 21*b* are engaged with the bolt 5 without causing the split surfaces 27*a*, 27*b* of the nut portions 21*a*, 21*b* to contact each other.

Figure 6C:
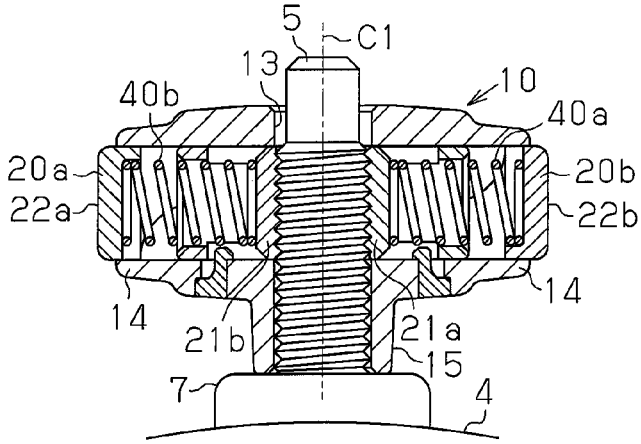
FIG. 6C is a partial cross-sectional view showing a state where the cymbal holder is tightened to the bolt.

Next, the player tightens up the cymbal holder 10, which is screwed to the bolt 5, as shown in FIG. 6C. At this time, as shown in FIG. 7B, the cymbal holder 10 is tightened up until the projection portion 15 contacts an upper end of the retainer 6. When the cymbal holder 10 is tightened up with the lower surface 12*b* of the cylindrical portion 12 facing downward, the projection portion 15 restricts the tightening amount of the cymbal holder 10 with respect to the bolt 5. In this case, since the depressed amount of the shock absorbing member 7 by the cymbal holder 10 is small, the tightening pressure of the cymbal 4 can be set to be relatively small.

Figure 7A:
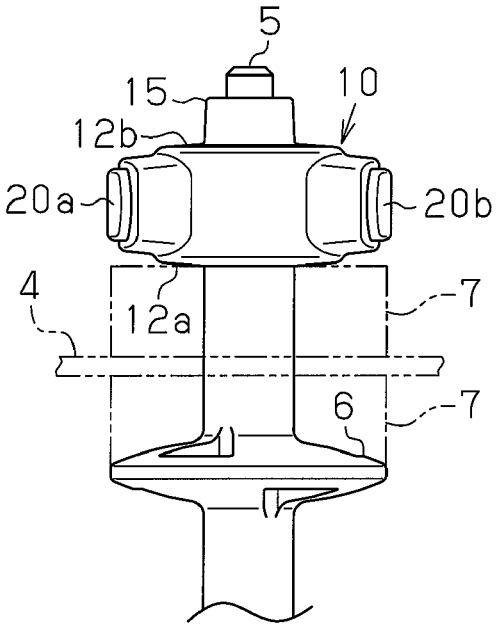
FIG. 7A is a partial side view of the cymbal holder that is tightened to the bolt with a projection portion facing upward.
Figure 7B:
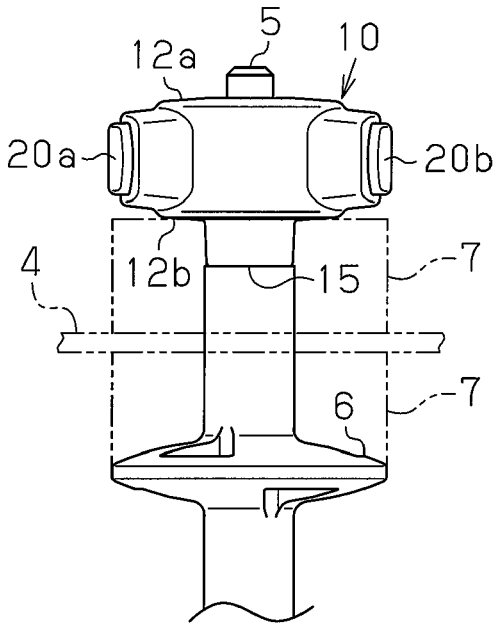
FIG. 7B is a partial side view of the cymbal holder that is tightened to the bolt with the projection portion facing downward.

On the other hand, as shown in FIG. 7A, when the cymbal holder 10 is tightened up with the upper surface 12*a* of the cylindrical portion 12 facing downward, the cymbal holder 10 is tightened up until the upper surface 12*a* contacts the upper end of the retainer 6 while pressing the upper surface 12*a* of the cylindrical portion 12 against the shock absorbing member 7. Therefore, the cymbal holder 10 is tightened up to be closer to the cymbal 4 as compared to the case shown in FIG. 7B. In this case, since the depressed amount of the shock absorbing member 7 by the cymbal holder 10 is great, the tightening pressure of the cymbal 4 can be set to be relatively great. Each of the shock absorbing members 7 holding the cymbal 4 is evenly depressed by substantially the same amount. Accordingly, the cymbal holder 10 is tightened up by the bolt 5 such that the cymbal 4 are attached to and held by the upper end of the stand body 2 as shown in FIG. 1.

When the above-described process is carried out in a reverse order, the cymbal 4 is removed from the stand body 2. Specifically, the first and second button portions 22*a*, 22*b* of the cymbal holder 10 that is tightened up to the bolt 5 are pinched by fingers to be pressed. This disengages the first and second nut portions 21*a*, 21*b* from the bolt 5. The cymbal holder 10 is pulled out from and removed from the bolt 5 in a state while the first and second button portions 22*a*, 22*b* are pressed. After the cymbal holder 10 is removed from the bolt 5, the cymbal 4 is removed from the stand body 2 with the shock absorbing member 7.

According to the present embodiment, the following advantages are obtained.

(1) The cymbal holder 10 has the holder body 11 having the insertion hole 13, the first and second engagement members 20*a*, 20*b*, and the first and second compression coil springs 40*a*, 40*b*. The first engagement member 20*a* has the first split nut as the first nut portion 21*a* and has the first operation button as the first button portion 22*a*. The second engagement member 20*b* has the second split nut as the second nut portion 21*b* and has the second operation button as the second button portion 22*b*.

According to this configuration, the bolt 5 is inserted through the insertion hole 13 of the holder body 11, and the nut portions 21*a*, 21*b* approach each other by the urging force of the first and second compression coil springs 40*a*, 40*b* to be engaged with the bolt 5 in the holder body 11. Therefore, when the cymbal 4 is struck and shaken, the nut portions 21*a* and 21*b* are prevented from opening and coming off the bolt 5. The nut portions 21*a*, 21*b* are separated from each other by the depression of the button portions 22*a*, 22*b* to release the engagement of the nut portions 21*a*, 21*b* and the bolt 5. Therefore, even if a stick contacts one of the button portions during the musical performance, the nut portions 21*a*, 21*b* are not removed from the bolt 5 as long as both button portions 22*a*, 22*b* are not depressed. Accordingly, the cymbal holder 10 is not easily removed from the bolt 5, and the cymbal 4 is reliably held by the cymbal stand 1.

(2) The inner diameter of the insertion hole 13 is set to be 1 to 11/10 times the outer diameter of the bolt 5. Accordingly, the clearance between the inner surface of the insertion hole 13 and the bolt 5 is set to be as small as possible within a range that allows the insertion of the bolt 5. Therefore, when the cymbal 4 is struck and shaken, the rattling of the cymbal holder 10 is suppressed. This effectively prevents that the nut portions 21*a*, 21*b* from being separated from each other and being removed from the bolt 5.

(3) The first and second nut portions 21*a*, 21*b* are engaged with the bolt 5 without causing the split surfaces 27*a*, 27*b* of the nut portions 21*a*, 21*b* to contact each other. According to this configuration, the engagement of each of the first and second nut portions 21*a*, 21*b* with the bolt 5 is not restricted by the other nut portion. This increases the engagement force between the nut portions 21*a*, 21*b* and the bolt 5 and improves the fastening strength of the nut portions 21*a*, 21*b* with respect to the bolt 5. Therefore, if the cymbal 4 is rotated around the bolt 5 during the musical performance, the cymbal holder 10 is not rotated with the cymbal 4. Therefore, the cymbal holder 10 is held so as not to be loosened from the state where the cymbal holder 10 is tightened up to the bolt 5.

(4) The cylindrical projection portion 15 is formed on the lower surface 12*b* of the cylindrical portion 12. The bolt 5 is inserted through the projection portion 15. According to this configuration, the cymbal holder 10 is tightened up in a state where the bolt is inserted through the cylindrical projection portion 15. Since the outer peripheral surface of the bolt 5 is covered by the projection portion 15 in this state, the inner peripheral surface of the attachment opening of the cymbal 4 does not slide with the outer peripheral surface of the bolt 5 when the cymbal 4 is struck and shaken. Therefore, the inner peripheral surface of the attachment opening of the cymbal 4 is not ground by the thread of the bolt 5.

(5) When the cymbal holder 10 is tightened up with the lower surface 12*b* of the cylindrical portion 12 having the projection portion 15 facing downward, the distal end of the projection portion 15 contacts the upper end of the retainer 6 and the tightening amount of the cymbal holder 10 with respect to the bolt 5 is restricted. On the other hand, when the cymbal holder 10 is tightened up with the upper surface 12*a* of the cylindrical portion 12 having no projection portion 15 facing downward, the cymbal holder 10 is tightened up until the upper surface 12*a* of the cylindrical portion 12 contacts the upper end of the retainer 6. Accordingly, the player selectively tightens up the cymbal holder 10 up-side-down so as to select the tightening pressure of the cymbal 4 and select one of two different sounds of the cymbal. According to this configuration, the projection portion 15, which protects the attachment opening of the cymbal 4, is used for selecting the tightening pressure of the cymbal 4. Therefore, no additional part is required. This achieves the cymbal holder 10 that allows the tightening pressure of the cymbal 4 to be selected without increasing the number of parts.

(6) The first engagement member 20*a* is formed by integrating the first split nut and the first operation button, and the second engagement member 20*b* is formed by integrating the second split nut and the second operation button. This configuration further reduces the number of parts of the cymbal holder 10. This reduces the manufacturing costs.

(7) The first and second engagement members 20*a*, 20*b* have the same shape and size. According to this configuration, the same mold can be used for molding the first and second engagement members 20*a*, 20*b*, and the first and second engagement members 20*a*, 20*b* are not assembled to each other by mistake.

(8) The cymbal holder 10 has the ring 50 as the retaining member. According to this configuration, the ring 50 holds the engagement members 20*a*, 20*b* so as not to come off from the holder body 11.

(9) The holder body 11, the first and second engagement members 20*a*, 20*b*, and the ring 50 are each made of a resin material. According to this configuration, most of the parts forming the cymbal holder 10 are made of resin. This reduces the weight of the cymbal holder 10 and the manufacturing costs.

(10) The cymbal stand 1 has the stand body 2 including a tripod, the tilter 3 and the cymbal holder 10. According to this configuration, the cymbal stand 1 having the above-described advantages is provided.

The present embodiment may be modified as follows.

In the present embodiment, the first and second nut portions 21*a*, 21*b* may be engaged with the bolt 5 while causing the split surfaces 27*a*, 27*b* of the nut portions 21*a*, 21*b* to contact each other.

In the present embodiment, the projection portion 15 may be provided on the upper surface 12*a* and the lower surface 12*b* of the cylindrical portion 12. In this case, the height of the projection portion 15 provided on each of the upper surface 12*a* and the lower surface 12*b* may be different. In this case, by tightening up the cymbal holder up-side-down, the tightening pressure of the cymbal is selected to select the sound of the cymbal.

The projection portion 15 may be omitted from the cylindrical portion 12 of the holder body 11. In this case, regardless of the attachment direction in which the cymbal holder 10 is tightened, the cymbal holder 10 is tightened until the upper surface 12*a* of the cylindrical portion 12 contacts the upper end of the retainer 6.

Figure 8:
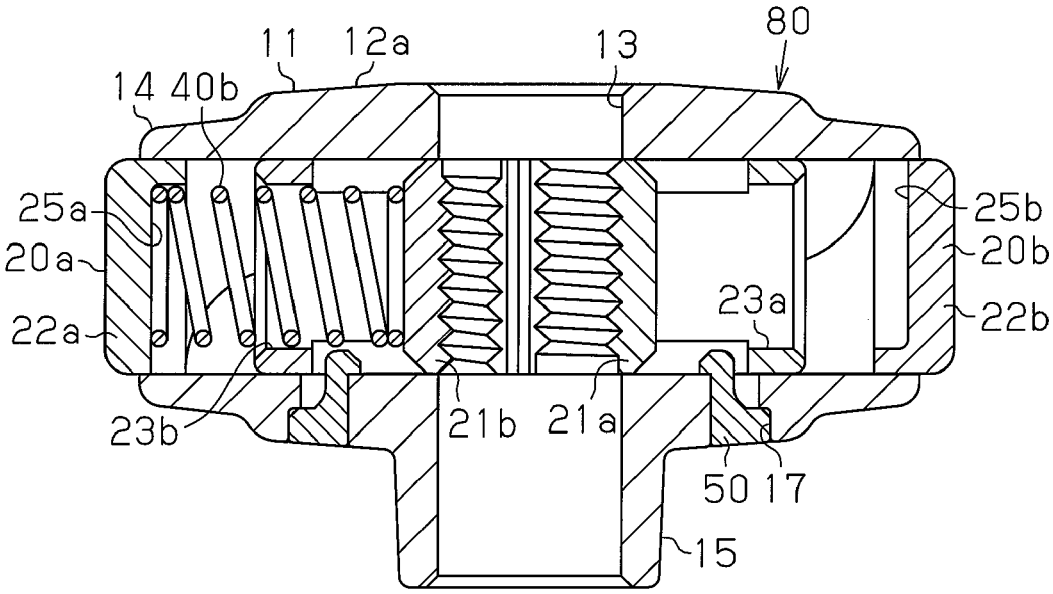
FIG. 8 is a vertical cross-sectional view of a cymbal holder according to a modification.

In the present embodiment, the first and second compression coil springs 40*a*, 40*b* are provided as the urging means. However, like a cymbal holder 80 shown in FIG. 8, one of the compression coil springs 40*a*, 40*b* may be omitted. In this case, the number of parts is less than that in the configuration shown in FIG. 3. This reduces the manufacturing costs.

In the present embodiment, a groove 17 for receiving the ring 50 may be provided on the upper surface 12*a* of the cylindrical portion 12, or may be provided on the upper surface 12*a* and the lower surface 12*b* of the cylindrical portion 12.

In the present embodiment, the holder body 11, the first and second engagement members 20*a*, 20*b* and the ring 50 may be made of a material other than a resin material, for example, wood or ceramics, as necessary.

Figure 9:
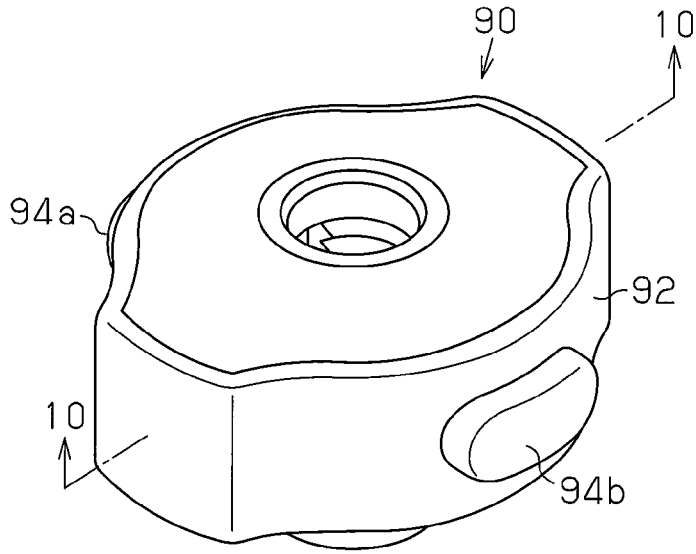
FIG. 9 is a perspective view of a cymbal holder according to another modification.
Figure 10:
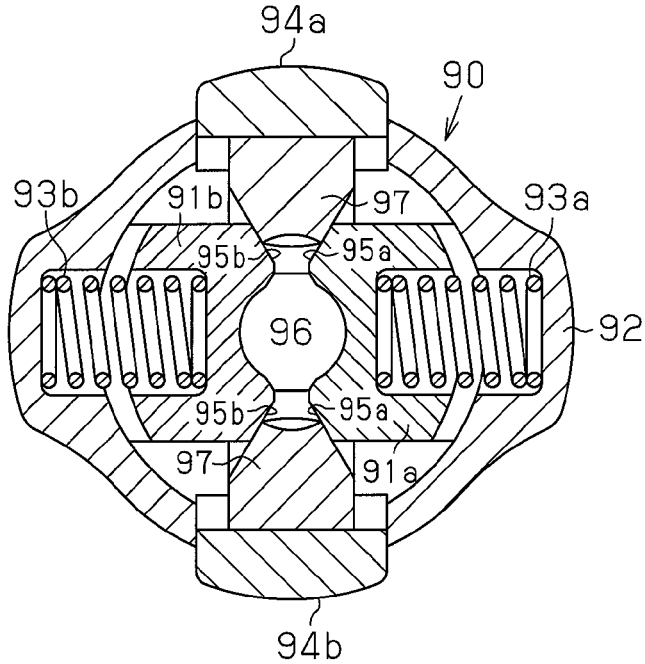
FIG. 10 is a transverse cross-sectional view of a cymbal holder according to another modification.

In the present embodiment, in place of the first and second engagement members 20*a*, 20*b*, the first split nut and the first operation button may be formed separately and the second split nut and the second operation button may be formed separately. For example, in a cymbal holder 90 shown in FIGS. 9 and 10, a first compression coil spring 93*a* is arranged between a first split nut 91*a* and a holder body 92, and a second compression coil spring 93*b* is arranged between a second split nut 91*b* and the holder body 92. The first and second button portions 94*a*, 94*b* is supported at opposite positions of a peripheral wall of the holder body 92. Each split surface 95*a*, 95*b* of the first and second split nuts 91*a*, 91*b* is formed as a tapered surface. The split surface 95*a* of the first split nut 91*a* and the split surface 95*b* of the second split nut 91*b* form a V-shaped groove. Each of the first and second button portions 94*a*, 94*b* has a base portion 97 whose end portion has substantially the same tapered angle as the V-shaped groove. The first and second button portions 94*a*, 94*b* are supported with the end portion of the base portion 97 inserted in the V-shaped groove. In the cymbal holder 90, when the first and second button portions 94*a*, 94*b* are pressed, the base portions 97 of the button portions 94*a*, 94*b* move further into the V-shaped groove, and the first and second split nuts 91*a*, 91*b* move so as to be separated from each other. As a result, a space 96 between the first and second split nuts 91*a*, 91*b* is enlarged.

In the present embodiment, the cymbal holder 10 is embodied to hold the cymbal 4 to the cymbal stand. However, the cymbal holder 10 may be embodied to hold the cymbal 4 to a cymbal rack or a cymbal attachment.

The invention claimed is:

1. A cymbal holder for holding a cymbal by tightening up the cymbal between a retainer supporting the cymbal and the cymbal holder, the cymbal holder being screwed to and tightened up to a bolt projected from an upper end of the retainer so as to hold the cymbal, the cymbal holder comprising:

a holder body having an insertion opening through which the bolt is inserted;

a first operation button and a second operation button that are provided to the holder body and operated for attachment and detachment of the cymbal;

a first split nut and a second split nut that are movably supported in the holder body and engaged with the bolt; and urging means for urging at least one of the split nuts, wherein the split nuts are caused to approach each other by urging force of the urging means so as to be engaged with the bolt, and the split nuts are separated from each other by operation of the operation buttons so as to be disengaged from the bolt.

2. The cymbal holder according to claim 1, wherein the inner diameter of the insertion hole is set to be 1 to 11/10 times the outer diameter of the bolt.

3. The cymbal holder according to claim 1, wherein the first and second split nuts are engaged with the bolt without causing split surfaces of the split nuts to contact to each other.

4. The cymbal holder according to claim 1, wherein the holder body has an upper surface and a lower surface, and a cylindrical projection portion through which the bolt is inserted is provided on at least one of the upper surface and the lower surface.

5. The cymbal holder according to claim 4, wherein the cymbal holder is tightened to the bolt with a shock absorbing member located between the cymbal holder and the retainer, and wherein tightening pressure of the cymbal is different between when the cymbal holder is tightened to the bolt with the upper surface of the holder body facing upward and when the cymbal holder is tightened to the bolt with the upper surface of the holder body facing downward.

6. The cymbal holder according to claim 5, wherein the projection portion is provided only on one of the upper surface and the lower surface of the holder body, and wherein, when the cymbal holder is tightened to the bolt with the surface on which the projection portion is provided facing downward, a distal end of the projection portion contacts an upper end of the retainer, and the tightening amount of the cymbal holder with respect to the bolt is restricted.

7. The cymbal holder according to claim 1, wherein the first split nut is integrally formed with the first operation button so as to form a first engagement member, and the second split nut is integrally formed with the second operation button so as to form a second engagement member.

8. The cymbal holder according to claim 7, wherein the first and second engagement members are engaged with each other in a state where the urging means is arranged between the first split nut and the second operation button and/or between the second split nut and the first operation button.

9. The cymbal holder according to claim 7, wherein the first and second engagement members have the same shape and size.

10. The cymbal holder according to claim 7, further comprising a retaining member that holds the first and second engagement members to prevent the engagement members from coming off from the holder body.

11. The cymbal holder according to claim 1, wherein the holder body, the first and second split nuts, and the first and second operation buttons are all made of resin.

12. A cymbal stand including a stand body having a bolt at its distal end and a cymbal holder for holding a cymbal at an upper end of the stand body, the cymbal being held at the stand body by tightening up the cymbal holder that is screwed to the bolt, the cymbal holder comprising:

a holder body having an insertion opening through which the bolt is inserted;

a first operation button and a second operation button that are provided on the holder body and operated for attachment and detachment of the cymbal;

a first split nut and a second split nut that are movably supported in the holder body and engaged with the bolt; and urging means for urging at least one of the split nuts, wherein the split nuts are caused to approach each other by urging force of the urging means so as to be engaged with the bolt, and the split nuts are separated from each other by operation of the operation buttons so as to be disengaged from the bolt.

* * * * *